US005104003A

United States Patent [19]

Stecoza

[11] Patent Number: 5,104,003

[45] Date of Patent: Apr. 14, 1992

[54] CABONATED BEVERAGE DISPENSING APPARATUS

[76] Inventor: Traian A. Stecoza, 45-36 39th Pl., Apt. 1K, Long Island City, N.Y. 11104

[21] Appl. No.: 641,124

[22] Filed: Jan. 14, 1991

[51] Int. Cl.[5] ..... B67D 5/00

[52] U.S. Cl. ..... 222/83.5; 222/88; 222/89; 222/181; 222/185; 222/325

[58] Field of Search ..... 222/81, 82, 83, 83.5, 222/88, 89, 91, 181, 184, 185, 325, 394

[56] References Cited

U.S. PATENT DOCUMENTS

| | | | |
|---|---|---|---|
| 1,933,192 | 10/1933 | Taylor | 222/89 X |
| 1,954,251 | 4/1934 | Lofgren | 222/89 X |
| 2,602,576 | 7/1952 | Spruck | 222/83 X |
| 2,655,286 | 10/1953 | Barbaro | 222/88 X |
| 3,685,694 | 8/1972 | Ianelli | 222/325 X |
| 3,827,601 | 8/1974 | Magrath et al. | 222/83 |
| 4,341,328 | 7/1982 | Redick, Jr. | 222/83.5 |
| 4,778,081 | 10/1988 | Vaughan | 222/83.5 |

FOREIGN PATENT DOCUMENTS

| | | | |
|---|---|---|---|
| 400253 | 12/1990 | European Pat. Off. | 222/83.5 |

*Primary Examiner*—Robert P. Olszewski
*Assistant Examiner*—Boris Milef
*Attorney, Agent, or Firm*—Leon Gilden

[57] ABSTRACT

A carbonated dispensing apparatus is provided to include a housing to mount a beverage container therewithin, with the housing including a piercing tube for projecting directly through a lid of a carbonated beverage container that is mounted in an inverted orientation relative to the housing.

4 Claims, 5 Drawing Sheets 16
10a
33
34
18a
35
36
45
37
39
41
38
44
42
43
40
29
46
31
30
13
32
32

CABONATED BEVERAGE DISPENSING APPARATUS

BACKGROUND OF THE INVENTION

1. Field of the Invention

The field of invention relates to fluid dispensing apparatus, and more particularly pertains to a new and improved carbonated beverage dispensing apparatus wherein the same includes a self-piercing tube within a carbonated beverage container.

2. Description of the Prior Art

Contemporary beverage containers are typically of an awkward and unyielding configuration, particularly in larger quantities. In conventional use, a lid is removed releasing a degree of carbonation from fluid within the container, the container is manipulated for pouring and subsequently the lid is replaced. The instant invention attempts to overcome deficiencies of the prior art by providing a container that permits release of a predetermined amount of fluid and effects sealing of the container to minimize loss of carbonation and orient the container in a manner to permit continuous dispensing of fluid therefrom. Examples of prior art fluid dispensing organizations may be found in U.S. Pat. No. 4,660,742 to Ozdemir wherein a system for activating dosage apparatus to dispense predetermined amounts of dosage from an inverted bottle is set forth.

U.S. Pat. No. 4,732,549 to Schukmann sets forth a pump structure to effect pumping of fluid from an underlying container.

U.S. Pat. No. 4,669,124 to Kimura sets forth a beverage container utilizing a tubular pouring spout projecting therefrom.

U.S. Pat. No. 4,673,109 to Cassia sets forth a liquid soap dispensing organization utilizing a valving structure to effect passage of liquid soap therethrough.

As such, it may be appreciated that there continues to be a need for a new and improved carbonated beverage dispensing apparatus as set forth by the instant invention which addresses both the problems of ease of use as well as effectiveness in construction in mounting the container in an inverted orientation and effecting sealing of the container during period of non-use.

SUMMARY OF THE INVENTION

In view of the foregoing disadvantages inherent in the known types of dispensing apparatus now present in the prior art, the present invention provides a carbonated beverage dispensing apparatus wherein the same mounts a beverage container permitting continuous fluid dispensing therefrom while minimizing loss of carbonation from the container. As such, the general purpose of the present invention, which will be described subsequently in greater detail, is to provide a new and improved carbonated beverage dispensing apparatus which has all the advantages of the prior art dispensing apparatus and none of the disadvantages.

To attain this, the present invention provides a carbonated dispensing apparatus to include a housing to mount a beverage container therewithin, with a housing including a piercing tube for projecting directly through a lid of a carbonated beverage container that is mounted in an inverted orientation relative to the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor it is intended to be limiting as to the scope of the invention in any way.

It is therefore an object of the present invention to provide a new and improved carbonated beverage dispensing apparatus which has all the advantages of the prior art dispensing apparatus and none of the disadvantages.

It is another object of the present invention to provide a new and improved carbonated beverage dispensing apparatus which may be easily and efficiently manufactured and marketed.

It is a further object of the present invention to provide a new and improved carbonated beverage dispensing apparatus which is of a durable and reliable construction.

An even further object of the present invention is to provide a new and improved carbonated beverage dispensing apparatus which is susceptible of a low cost of manufacture with regard to both materials and labor, and which accordingly is then susceptible of low prices of sale to the consuming public, thereby making such carbonated beverage dispensing apparatus economically available to the buying public.

Still yet another object of the present invention is to provide a new and improved carbonated beverage dispensing apparatus which provides in the apparatuses and methods of the prior art some of the advantages thereof, while simultaneously overcoming some of the disadvantages normally associated therewith.

Still another object of the present invention is to provide a new and improved carbonated beverage dispensing apparatus wherein the same mounts a container in an inverted orientation and sealingly positions a dispensing conduit through a lid of the container in operative association with a valve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
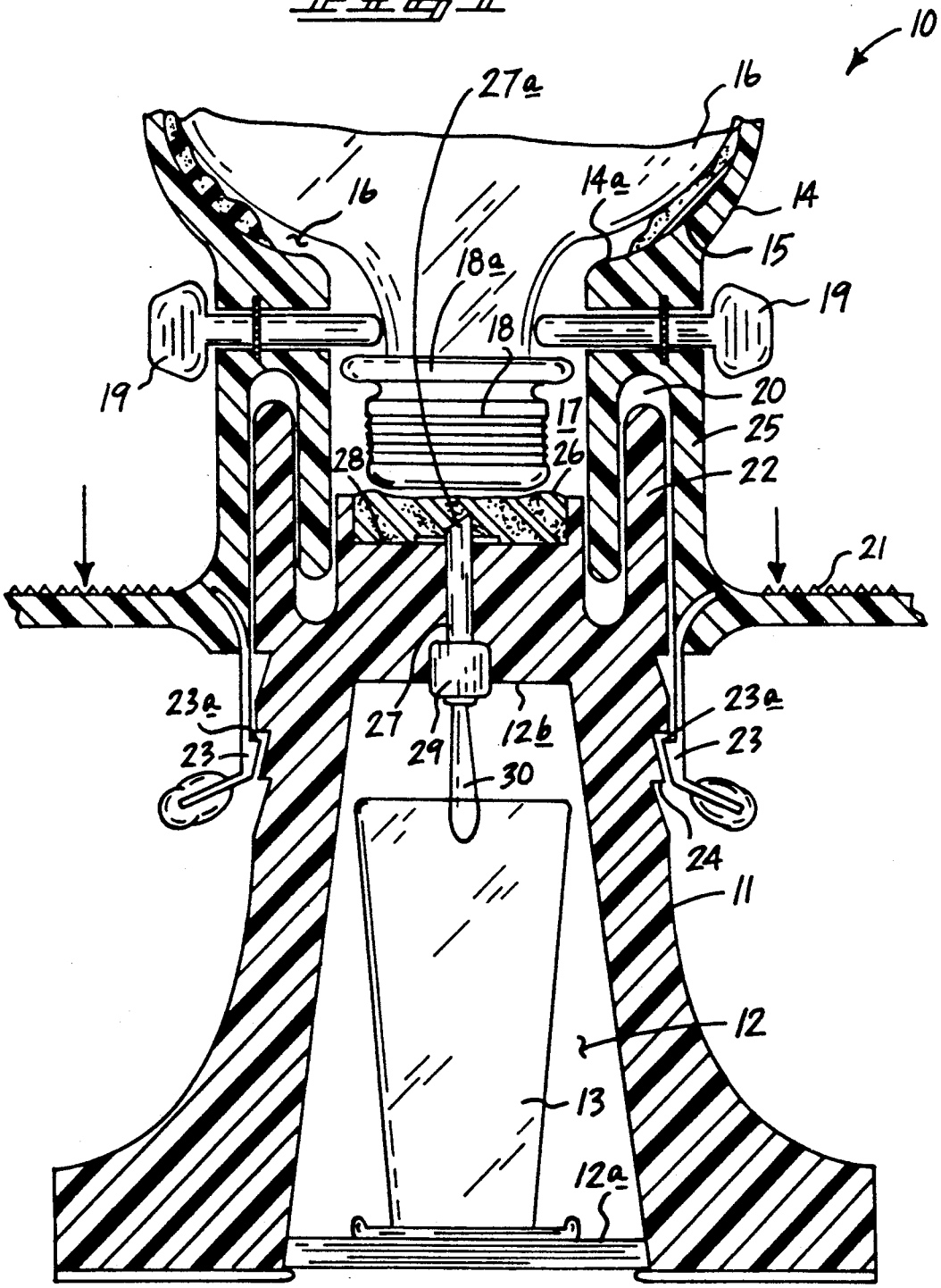
FIG. 1 is an orthographic cross-sectional illustration of the instant invention.

With reference now to the drawings, and in particular to FIGS. 1 to 6 thereof, a new and improved carbonated beverage dispensing apparatus embodying the principles and concepts of the present invention and generally designated by the reference numerals 10, 10*a*, 10*b*, and 10*c* will be described.

More specifically, the carbonated beverage dispensing apparatus 10 of the instant invention essentially comprises a lower support housing 11, including a medially positioned central cavity 12 that is coaxially aligned within the support housing 11, and includes a cavity mounting plate floor 12*a* and an overlying cavity roof 12*b*. A receiving container or cup 13 is mounted upon the floor 12*a* in a coaxially aligned relationship within the central cavity 12. An upper housing 14 is removably mounted relative to the lower support housing 11 and includes a conical support shoulder 14*a* mounting a beverage container 16 upon a cushion liner 15 laminated upon the support shoulder 14*a*. The conical support shoulder 14*a* is formed underlying a housing upper cavity 16*a* to receive the container 16, as illustrated. An upper housing lower cavity 17 of a generally cylindrical configuration is coaxially aligned relative to the upper housing 14 to receive the neck and beverage container lid 18 of the associated container. A beverage container spout flange 18*a* of a generally annular configuration is mounted about the spout spaced above the lid 18 when the container is in an inverted configuration, as illustrated in FIG. 1. Diametrically opposed lock pins 19 are directed through the upper housing 14 in communication with the spout of the container 16 and effect an abutment to overlie the spout flange 18*a*, as illustrated, as the lock pins project into the upper housing lower cavity 17. An annular upper groove 20 is coaxially formed within the upper support housing 14 surroundingly positioned about the upper housing lower cavity 17. A "U" shaped flange 25 is thereby formed by the upper housing to receive and define the upper groove 20. An annular pressure ring 21 is integrally mounted to a lower terminal end of the housing 14 to accommodate manual pressure directed thereon to direct the upper housing onto the lower housing. To this end, an annular lower flange 22 is coaxially and integrally formed to the lower support housing 11 and is defined by a length substantially equal to a length defined by the annular upper groove 20 to permit reception of the lower flange 22 within the upper groove 20. Diametrically opposed spring latches 23, including latch recesses 23*a*, are securable to stepped ridges 24 formed circumferentially about an exterior surface of the lower support housing 11 below the lower flange 22 to frictionally lock the upper housing 14 to the lower support housing 11. A resilient sealing plug 26 is mounted to a lower housing central upper surface 28 coaxially formed to the lower housing defining a planar surface to receive a resilient sealing plug 26 thereon. A rigid tubular conduit 27 that includes a tubular conduit upper piercing tip 27*a* is coaxially arranged relative to the upper housing 14 and the lower housing 11 and is fixedly mounted to the lower housing projecting from the cavity roof 12*b* to the lower housing central upper surface 28. Upon directing of the upper housing 14 over the lower housing 11, the piercing tip 27*a* is directed through the lid 18, whereupon the sealing plug 26 effects sealing preventing fluid loss or seepage from within the container. A valve 29 operative through a valve conduit 30 directs fluid selectively from the container 16 into the receiving container or cup 13.

Figure 2:
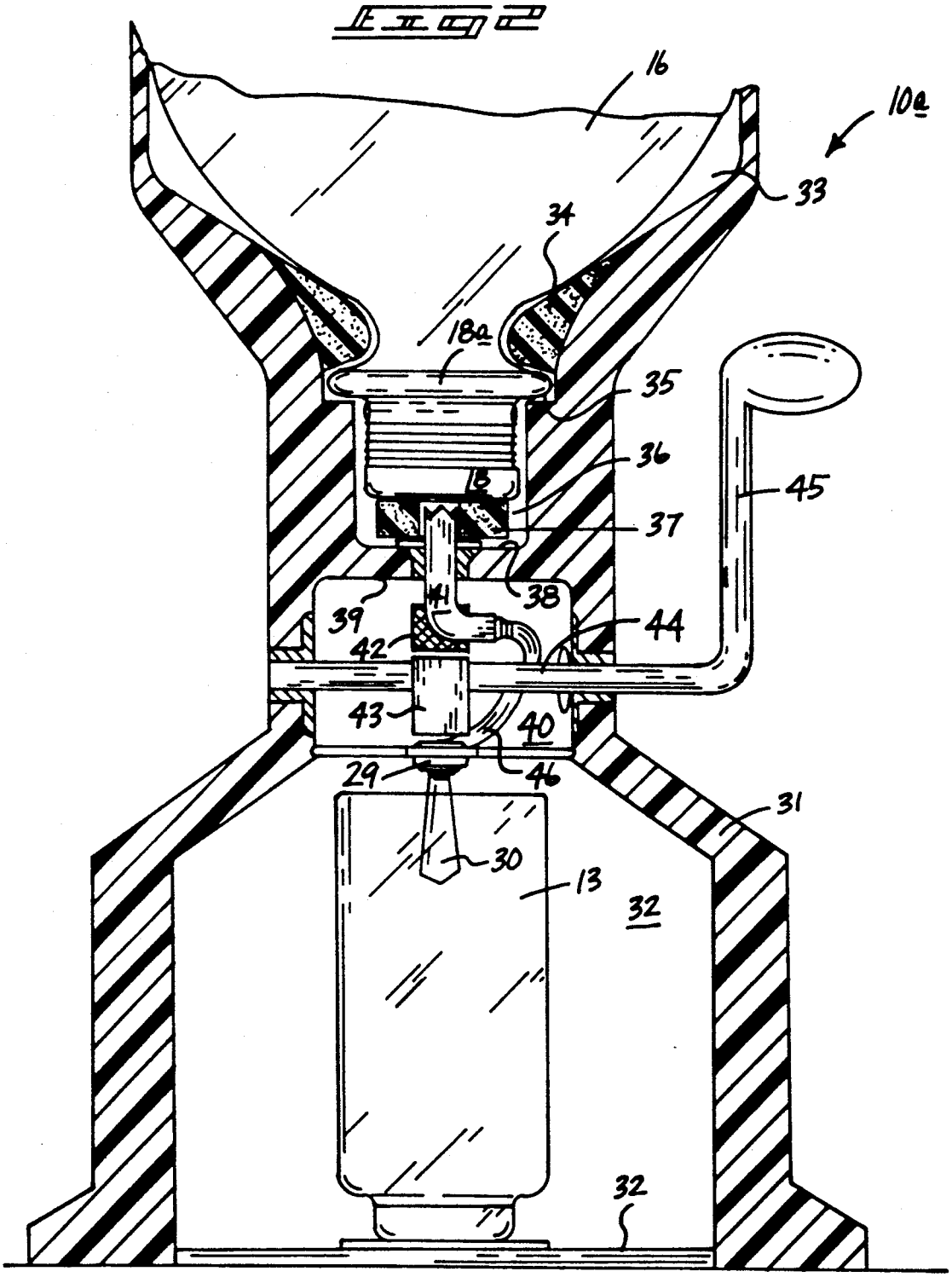
FIG. 2 is an orthographic cross-sectional illustration of a modification of the instant invention.
Figure 3:
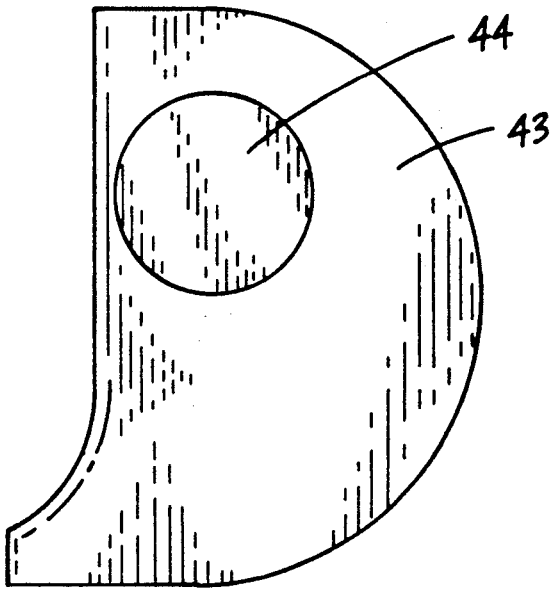
FIG. 3 is an orthographic cross-sectional illustration of a cam utilized by the invention, as set forth in FIG. 3.

FIG. 2 illustrates a modified apparatus 10*a*, wherein a unitary support housing 31 includes a support housing lower cavity 32 mounting the cup 13 medially thereof permitting positioning of the cup upon the lower cavity support floor 32*a*. The support housing upper cavity 33 coaxially aligned relative to the lower cavity mounts the container 16 therewithin. A spout flange receiving groove 35 receives and secures the spout flange 18*a* therewithin between a clamping flange 34 and an annular surface defined at a lower terminal end of the upper cavity 33. A medial housing cavity 36 receives the lid 18 therewithin onto an associated sealing plug 37. A medial housing cavity floor 38 mounts the sealing plug 37 thereon. A rigid piercing conduit 41 coaxially directed from the spout cavity 40 through to the medial housing cavity 36 projects from the housing groove 39 through the floor 38 of the medial housing cavity. The rigid piercing conduit 41 is integrally secured to a cam follower 42 that overlies a cam member 43. The cam member 43 is fixedly mounted to a rotatable cam shaft 44 that is rotatable by use of the cam shaft handle 45. Upon rotation of the cam shaft handle 45, the cam follower 42 is coaxially directed upwardly relative to the valve cavity and the medial housing cavity 36 to pierce the lid 18. The valve 29 and associated valve conduit 30 thereafter permits directing of fluid from the container 16 into the underlying cup 13. A flexible delivery conduit 46, as illustrated, operatively associates a rigid conduit 41 with the valve 29 and accommodates reciprocation of the piercing conduit 41 within a valve cavity 40.

Figure 4:
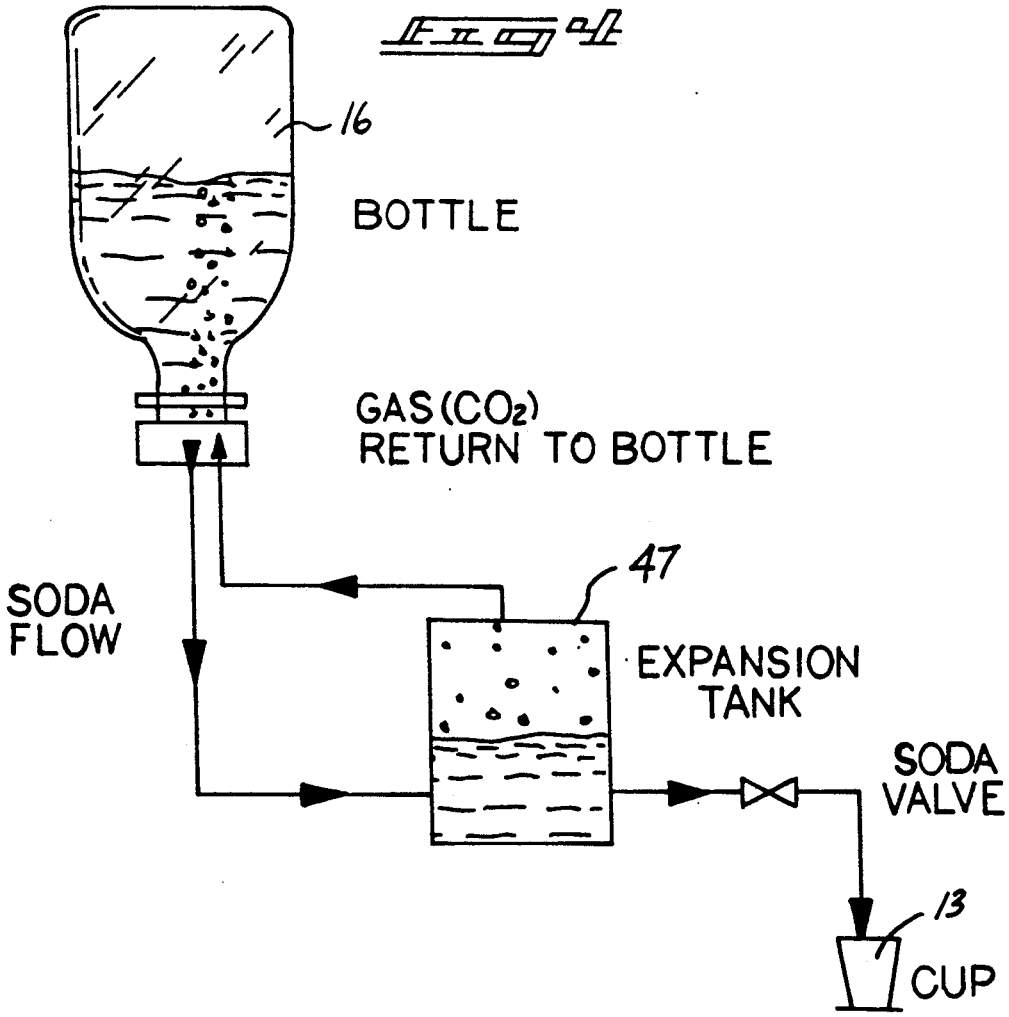
FIG. 4 is a diagrammatic illustration of an expansion tank as utilized by the instant invention.

FIG. 4 illustrates the use of an expansion tank 47 in operative association with the flexible conduit 40 to permit directing of carbonation within the expansion tank back into the bottle 16 assisting and maintaining of the pressure within the beverage container 16 or bottle during use.

Figure 5:
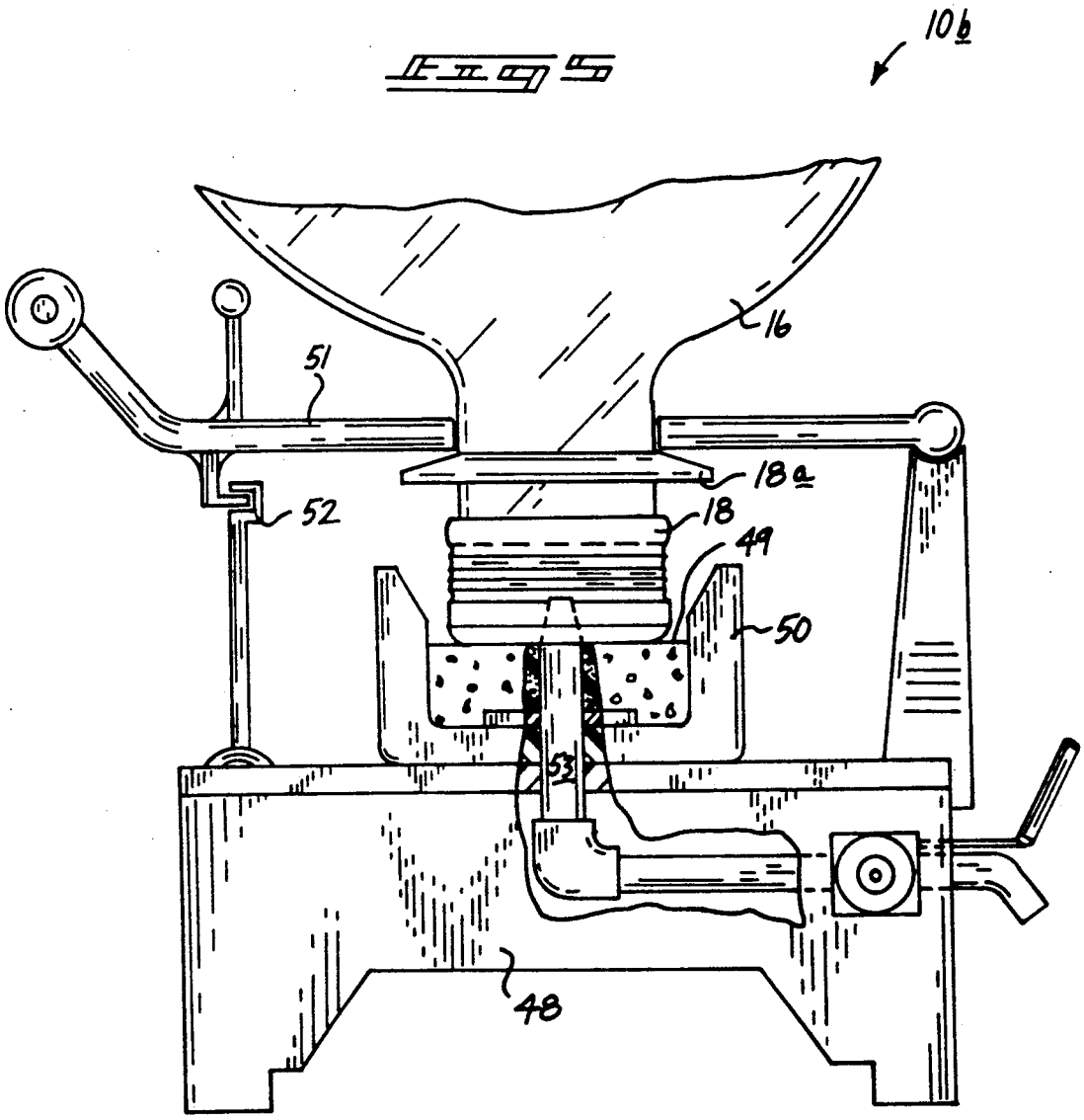
FIG. 5 is an orthographic side view, partially in section, of a further modified mounting of a beverage container to an underlying support.

FIG. 5 illustrates a further modified apparatus 10*b*, wherein a support base 48 mounts a seal plug 49 within a seal plug cradle 50. A clamping annulus 51 overlies the spout flange 18*a* and latches the container 16 to the seal plug 49 upon the handle 15 and is manipulated to position a locking flange within a "U" shaped clamp groove 52. A nozzle 53 is projected through the lid 18 during a clamping procedure, in a manner as set forth above.

Figure 6:
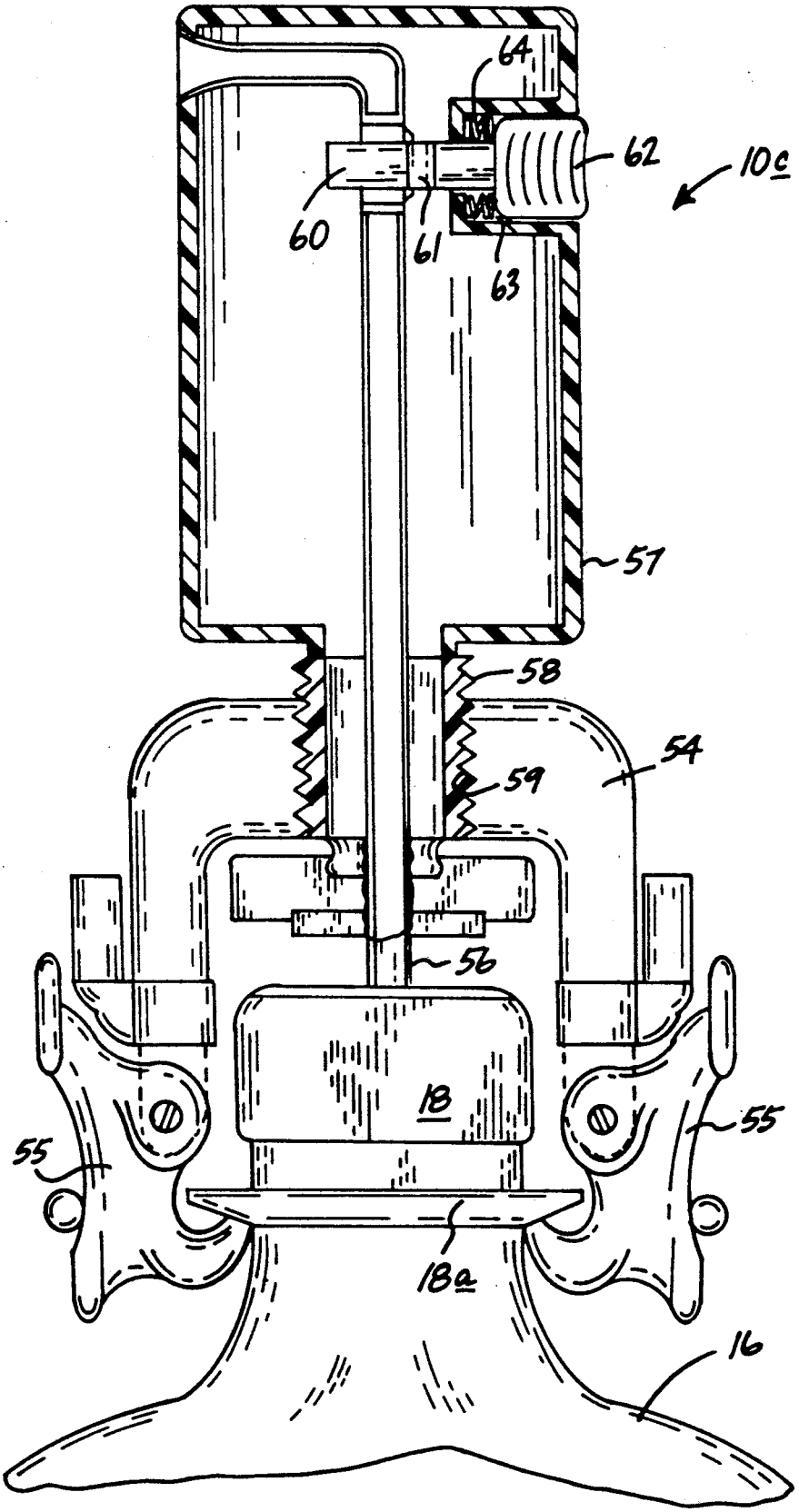
FIG. 6 is an orthographic side view, partially in section, of a yet further modification of the instant invention.

FIG. 6 sets forth a further modified apparatus 10*c*, wherein a "U" shaped clamp 54 includes diametrically opposed flange clamps 55 to secure the flange clamps to the spout flange 18*a*. A tubular piercing rod 56 is directed through the lid 18 upon threaded rotation of a threaded cylindrical neck 58 into an internally threaded frame bore 59 medially directed through the frame 54 in coaxial alignment with the lid 18. A valve rod 60 including a valve rod opening 61 is selectively aligned with the piercing rod 56 to permit directing of fluid therethrough. A valve rod boss 62 is selectively projected radially inwardly of the cylindrical mount 57 to align the opening 61 with the tubular piercing rod 56. A cavity 63 formed within the cylindrical mount 57 captures a plurality of springs 64 between a wall of the cavity 63 and the boss 62 to resiliently bias the valve rod opening 61 in a displaced orientation relative to the tubular piercing rod 56 until manual or mechanical depressing of the boss 62 to align the opening 61 with the tubular piercing rod 56.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A carbonated beverage dispensing apparatus comprising, in combination, a lower support housing and an upper support housing, the upper support housing reciprocatably securable relative to the lower support housing, and clamping means to secure the upper support housing to the lower support housing, and the lower housing including a lower housing cavity, and the lower housing including a lower support housing cavity, and a floor defining a lower terminal end of the lower support housing cavity, and the upper support housing including upper support housing upper cavity, and upper support housing lower cavity, wherein the lower support housing cavity, the upper support housing upper cavity, and the upper support housing lower cavity are coaxially aligned relative to one another, and a container, the container including a central body, a container spout coaxially formed to the central body, a lid mounted to the spout, and an annular spout flange mounted to the spout between the body and the lid, and the container positionable within the upper housing upper cavity, with the spout positioned within the upper housing lower cavity, and a plurality of diametrically opposed lock pins directed through the upper housing and projecting within the upper housing lower cavity positioned above the spout flange, and a rigid tubular conduit mounted within the lower housing coaxially thereof projecting into the upper housing lower cavity and into the lid to direct fluid from the container into the lower housing cavity, and a valve mounted in fluid communication with the tubular conduit to selectively direct flow from the container into the lower housing cavity.

2. An apparatus as set forth in claim 1 wherein the clamping means includes an annular pressure ring fixedly mounted to a lower terminal end of the upper support housing extending laterally thereof, with the annular pressure ring including a plurality of diametrically opposed spring latches, and the lower support housing including a plurality of spaced annular ridges mounted circumferentially about the lower support housing cooperative with the spring latches when the upper support housing is projected overlying the lower support housing.

3. An apparatus as set forth in claim 2 wherein the upper support housing includes an annular upper groove formed within the upper support housing coaxially about the upper housing lower cavity, and the groove defined by a predetermined length, and the groove defined within a "U" shaped flange defining a lower terminal end of the upper support housing, and the lower support housing including a lower flange defined by the predetermined length receivable within the groove.

4. An apparatus as set forth in claim 3 wherein the lower housing cavity includes a cavity roof, and the lower support housing further includes a lower housing central upper surface, with the lower cavity central upper surface coaxially aligned with the cavity roof and arranged parallel thereto, with the tubular conduit projecting through the lower housing central upper surface, and the valve in fluid communication with the rigid tubular conduit, and the rigid tubular conduit including an upper piercing tip projecting above the lower housing central upper surface, and a resilient sealing plug positioned on the lower housing central upper surface between the container lid and the lower housing central upper surface containing the tubular conduit upper piercing tip therewithin to effect sealing of the lid when the tubular conduit upper piercing tip is directed through the lid.

* * * * *